US006611207B1

(12) United States Patent
Yuan et al.

(10) Patent No.: US 6,611,207 B1
(45) Date of Patent: Aug. 26, 2003

(54) METHOD FOR DETECTING FIRE WITH LIGHT SECTION IMAGE TO SENSE SMOKE

(75) Inventors: Hongyong Yuan, Anhui (CN); Weicheng Fan, Anhui (CN); Guofeng Su, Anhui (CN); Binghai Liu, Anhui (CN); Shenyou Liu, Anhui (CN); Qingan Wang, Anhui (CN)

(73) Assignee: University of Science and Technology of China (CN)

( * ) Notice: Subject to any disclaimer, the term of this patent is extended or adjusted under 35 U.S.C. 154(b) by 0 days.

(21) Appl. No.: 09/958,730

(22) PCT Filed: Mar. 23, 2000

(86) PCT No.: PCT/CN00/00059

§ 371 (c)(1),
(2), (4) Date: Jan. 24, 2002

(87) PCT Pub. No.: WO00/63863

PCT Pub. Date: Oct. 26, 2000

(30) Foreign Application Priority Data

Apr. 16, 1999 (CN) ..... 99102679 A

(51) Int. Cl.[7] ..... G08B 17/10

(52) U.S. Cl. ..... 340/630; 340/588; 340/589; 340/555; 340/556; 340/628

(58) Field of Search ..... 340/630, 588, 340/589, 555, 556, 628

(56) References Cited

U.S. PATENT DOCUMENTS

| | | | | | |
|---|---|---|---|---|---|
| 4,131,888 | A | * | 12/1978 | Garvin | 340/630 |
| 4,614,968 | A | * | 9/1986 | Rattman et al. | 358/93 |
| 5,237,308 | A | * | 8/1993 | Nakamura | 340/588 |
| 5,289,275 | A | * | 2/1994 | Ishii et al. | 348/154 |
| 5,592,151 | A | * | 1/1997 | Rolih | 340/584 |
| 5,937,077 | A | * | 8/1999 | Chan et al. | 382/100 |

* cited by examiner

*Primary Examiner*—Daniel J. Wu
*Assistant Examiner*—Tai T. Nguyen
(74) *Attorney, Agent, or Firm*—Dilworth & Barrese, LLP

(57) ABSTRACT

The present invention relates to a method for detecting fire with light section image to sense smoke. Infrared radiation arrays (1) and infrared cameras (2) are provided in a monitored area. The images of the infrared light spots transmitted by the infrared radiation arrays (1) are converted into video signals by the infrared cameras (2), and transferred to a video switcher (3). The video switcher sends the video signals received from the infrared cameras to a computer (4) one by one. The computer processes the signals. If fire is sensed, the computer controls the alarm unit (5) to alarm by a linkage.

9 Claims, 2 Drawing Sheets

METHOD FOR DETECTING FIRE WITH LIGHT SECTION IMAGE TO SENSE SMOKE

FIELD OF THE INVENTION

The present invention relates to a method for detecting fire, in particular to detect fire with light section image to sense smoke.

DESCRIPTION OF THE RELATED ART

In most cases, the presence of smoke in fire is earlier than that of open fire, so a smoke-sensing fire detector has been applied widely. At present, the smoke-sensing fire detectors used in various places include ionic smoke-sensing fire detectors, photoelectric smoke-sensing fire detectors, as well as the analog alarm type fire detectors and automatic floating type fire detectors responding to a threshold, which have the primary intelligence. The existing fire detectors may alarm in error or late due to the color of the smoke, the size of the particles, the height of the space, airflow, and shake, etc., and alarm in error or miss the alarm due to the dust accumulation and the environmental variation.

OBJECT OF THE INVENTION

Accordingly, it is an object of the present invention to provide a method for detecting fire with a smoke-sensing light section image to achieve a high sensitivity to flaming fire and non-flaming fire, high anti-interference ability, low error alarm ratio, and adaptation to the large space.

SUMMARY OF THE INVENTION

The method of the present invention is implemented as follows.

According to one aspect of the present invention, there is provided a method for detecting fire with a smoke-sensing light section image, characterized in that infrared radiation arrays and infrared cameras are provided in a monitored area, the infrared light beams emitted by the infrared radiation array pass through the monitored area, and the infrared light spots are imaged on the light target arrays of the infrared cameras, the images of the infrared light spots are converted into video signals by the infrared cameras, and then transferred to a video switcher, the video switcher sends the video signals received from the infrared cameras to a computer one by one in polling manner, and wherein after the video signals are input to a computer, the computer analyzes and processes the variation of the video signals in the manner of template matching, tendency analysis and correlation analysis, the computer controls an alarm unit to alarm by a linkage if fire is sensed.

COMPARISON WITH PRIOR ART

The advantages of the present invention are in that:

(1) The light section formed by multi-beam light can cover the protected space in arbitrary curved surface, so that the area of the fast response region is greatly increased, and then it is possible to alarm in a large space early.

(2) Correlation analysis for adjacent beams in the light section can eliminate the error alarm caused by accidental factors in a single-beam of light fire alarm unit.

(3) The shift of operating conditions caused by dust accumulation is detected and traced automatically. When the shift exceeds a given range, a faulty signal is produced automatically. Meanwhile, such a fire detector can automatically modify the operating parameters thereof in accordance with the variation of the environment, so that the error and missed alarm caused by the dust accumulation and the environmental variation are reduced significantly.

(4) Surface imaging auto-tracing fixed-point detection may completely solve the problems of the error alarm caused by installing and moving the conventional linear smoke-sensing unit.

(5) By using the technique of surface imaging, the method for sensing smoke with light section image is capable of distinguishing an emitting light source from an interference light source. Therefore, the anti-interference performance of the system is enhanced, and then the application fields are enlarged widely.

The method of the present invention may be applied to the fire detection in a large and long space. It can achieve the abilities to adapt various environments, to acquire information with low cost, to install facilely, and to install in multi-layers.

BRIEF DESCRIPTION OF THE DRAWINGS

The above and other objects, advantages, and features of the present invention will be more apparent from the following description taken in conjunction with the accompanying drawings, in which.

DETAILED DESCRIPTION OF THE PREFERRED EMBODIMENT

Figure 1:
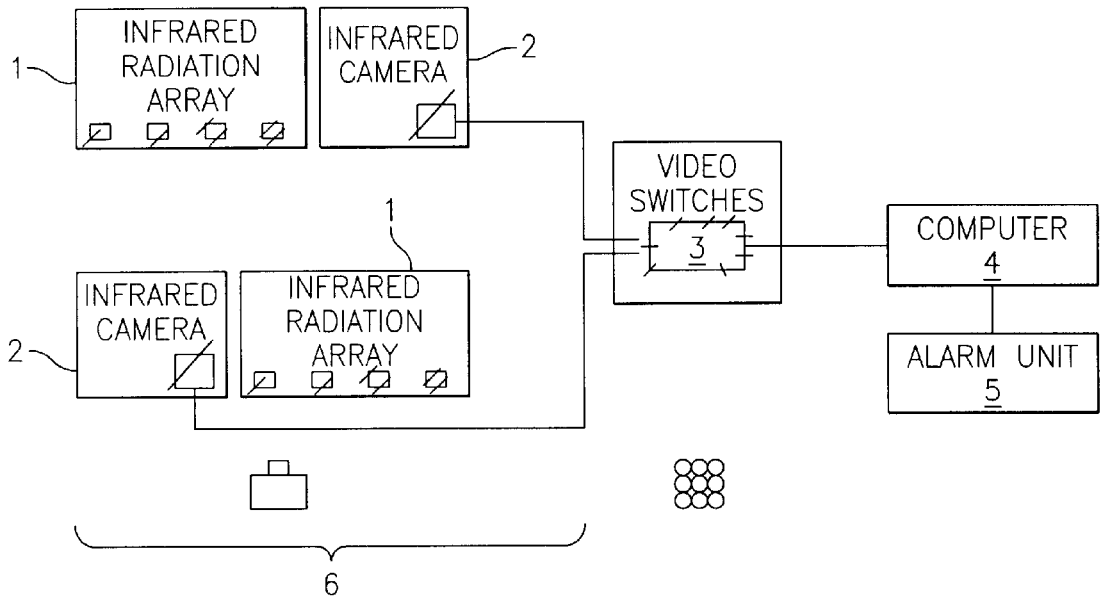
FIG. 1 is a schematic block diagram showing a fire detection system of an embodiment of the present invention.

Referring to FIG. 1, the fire detector of an embodiment of the present invention is described. As shown in FIG. 1, the fire detection system includes infrared radiation arrays 1, infrared cameras 2, a video switcher 3, a computer 4, and an alarm unit 5 which is controlled by a linkage. Reference numeral 6 shows the principle of forming a light section. Infrared radiation arrays 1 and infrared cameras 2 are provided in the monitored space. According to the requirements of fire prevention for the site, the infrared radiation arrays 1 and the infrared cameras 2 are arranged in such a way that the section formed by the infrared radiation arrays and the infrared cameras may show the conditions of the all space of the site to monitor on the monitored space effectively. The infrared light beams emitted by the infrared radiation arrays pass through the monitored space, and the infrared light spots are imaged on the light target array of the infrared cameras. The infrared cameras set at different positions can convert the image of infrared light spots into video signals and then transfer them to a video switcher 3. The video switcher 3 sends the video signals to the computer 4 one by one in polling manner. The computer 4 analyzes, on the basis of the strength of the received video signals, whether there is fire or not. If fire is sensed, the computer 4 may control alarm unit 5 to alarm by a linkage.

Figure 2:
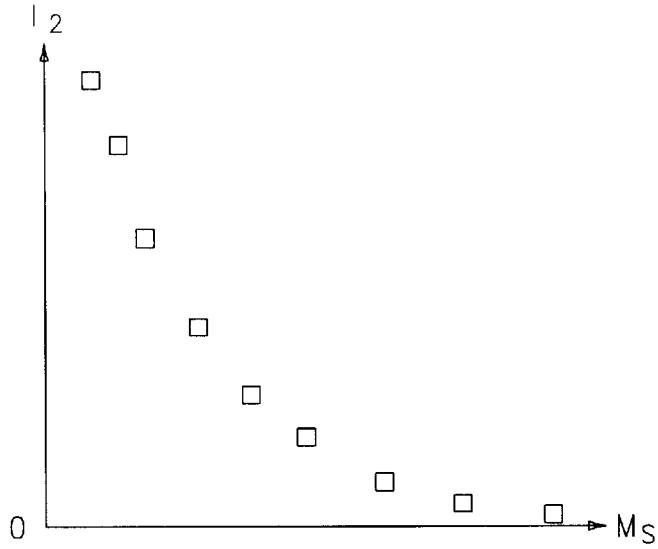
FIG. 2 is a graph showing the relationship of smoke density versus transmission intensity of light.
Figure 3:
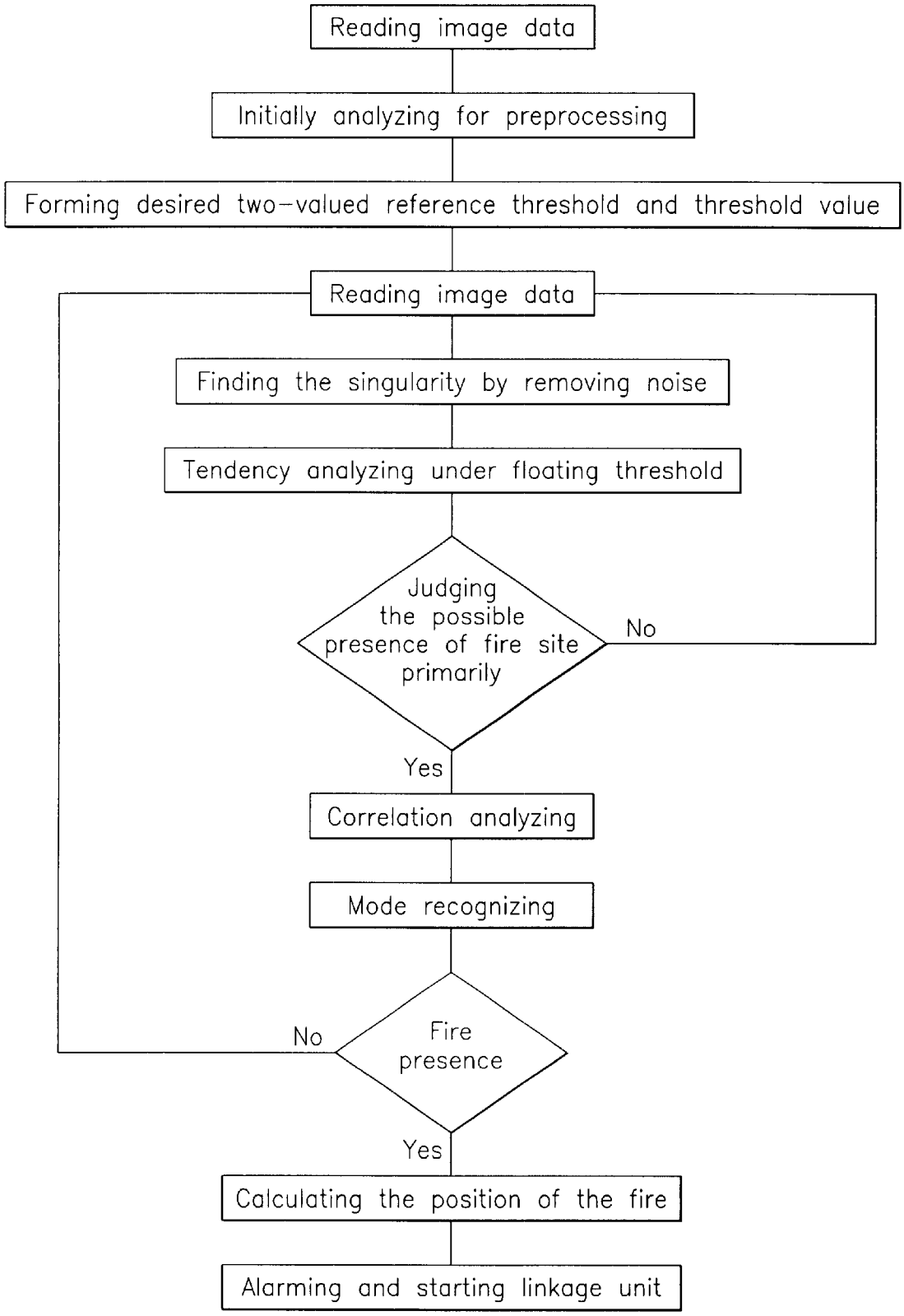
FIG. 3 is a flowchart explaining the steps preformed when the fire detection system shown in FIG. 1 detects fire.

FIG. 2 is a graph showing the relationship of smoke density versus transmission intensity of light and FIG. 3 is a flowchart explaining the steps preformed when the fire detection system shown in FIG. 1 detects fire. Light beams may be refracted, scattered and absorbed when they pass through the air. After the beams pass through the air, their intensity directly depends on the density of particles that may refract, scatter and absorb the light in air. The relationship between them is as follows:

$$I_\lambda = I_{\lambda 0}\exp(-KL)$$

where $I_{\lambda 0}$ indicates the intensity of the incident light, $I_\lambda$ indicates the intensity of the light which passes through the smoke, L is the average run length of the ray and K is the extinction coefficient, which is an important parameter to characterize extinction coefficient, and may be further expressed as the product of the extinction coefficient($K_m$) of the smoke mass density per unit multiplied by the smoke mass density ($M_s$).

$$K = K_m M_s$$

where $K_m$ is extinction coefficient, which is dependent on the size distribution of smoke particles and properties of the incident light, that is, $$K_m = \frac{3}{2\rho_s}\int_{d_{\min}}^{d_{\max}} \frac{1}{d}\cdot\frac{\delta M_s}{\delta d} Q_{est}\left(\frac{d}{\lambda}n_r\right)\delta d$$

where δ is differential symbol, d is the diameter of smoke particles, $\rho_s$ is the density of smoke particles. $Q_{ext}$ is the extinction coefficient of a single particle, which is a function of a ratio of the particle diameter to the wavelength ($d/\lambda$) as well as compound refractivity of particles ($n_r$). As common wood or plastic is burned, the value of smoking extinction coefficient $K_m$ is about 7.6 $m^2/g$. The value of smoking extinction coefficient $K_m$ thereof in pyrogenic decomposition is about 4.4 $m^2/g$.

When wood or plastic is under the condition of the initial fire, $K=4.4M_s$. If detecting distance L is 50 m, then $$I_\lambda = I_{\lambda 0}\exp(-220M_s)$$

Accordingly, the fire can be judged by analyzing the variations of $I_\lambda$ after $I_{\lambda 0}$ and $M_s$ have been known. In the actual operation, since the infrared light beams pass through the air and form the images of infrared light spots on infrared cameras with the spot brightness X, where $X I_\lambda$), one can determine whether the fire appears or not by analyzing the attenuation of X.

Each of the infrared cameras faces a string of infrared light spots. These infrared light spots are sent to a computer by a video switcher one by one in polling manner. These spots are digitized by the computer and then are stored in the memory of the computer. Firstly, it is necessary to segment and extract these light spots in order to measure their brightness. The light spot is separated from its background by means of dynamic histogram threshold segmentation and template matching, so that a series of brightness values of the light spots are measured in real time.

$$X_1(1)X_2(1)X_3(1)\ldots X_n(1)$$

$$X_1(2)X_2(2)X_3(2)\ldots X_n(2)$$

$$X_1(3)X_2(3)X_3(3)\ldots X_n(3)$$

$$X_1(t)X_2(t)X_3(t)\ldots X_n(t)$$

where t is the measured value at timing t, n is the n−th spot.

According to the present invention, it can determine whether there is fire or not by using the fire recognition mode via analyzing $x_1(j)$ (i=1, 2 . . . , j=1, 2 . . . t). The present invention utilizes fire recognition modes of mode recognition, sustained tendency and prediction adaptation. Its operating principle is as follows.

Image information is analyzed in real time, and the information is compared and matched with smoke features, and then conclusions can be obtained.

For one specific light spot, a progression is extracted from a continuous timing diagram, $$x_i = \{x_i(k)\ |k=1, 2, \ldots, n\}$$

$$x_0 = \{x_0(k)\ |k=1, 2, \ldots, n\}\ldots \text{reference progression}$$

The noise of each of the progressions is removed by analyzing the wavelet, and the progressions are classified approximately. The mechanism of the processing is in that the singularity of the signal which is based on features of white noise is completely different under wavelet transform. Now, it is analyzed as follows:

$$f(x)\epsilon^\circ\ C.(R)\ (0<a<1)\ \text{if}$$

$$|f(x)-f(y)\ |=0\ (|x-y|^2)$$

it is assumed that ψ(x) is a allowable wavelet, and |ψ(x)|, |ψ'(x) |=0 (1+|x|$^{-2}$), it is written as $$\psi_{j,k}(x) = 2^{1/2}\psi(2'x-k)$$

$$W_2 f(x) = 2^{1/2}\int_R f(t)\psi(2't-x)dt$$

then $$|W^j{}_2 f(x)\ | = O(2^{-(1/2+\alpha)j})$$

For a wide stationary white noise n(x) with $\alpha^2$ variance, it can conclude $W2^j n(x)=2^j/2(n(t)\ \psi(2^j t-x))$, and ψ(x) is supposed as a real function. Thus $$|W2'n(x)^2 = 2'\int\int_R n(u)\ n(v)\ \psi(2'(n-x))\ \psi(2'(v-x))dudv$$

then $$E|W2'n(x)\ |^2 = 2'\int\int_R \sigma\delta(u-v)\ \psi(2'(u-x))\ \psi(2'(v-x))dudv = 2'\sigma^2 \int|(2'(u-x))|^2 du = \sigma^2\|\psi\|^2$$

It indicates that $W2^j n(x)$, which is an average power of a stationary random process, has no relation with the size of 2j. Then, each of the progression calculates the tendency values with the variable window sustained time tendency algorithm. The procedure is as follows: defining an accumulative function K(n) as $$K(n+1) = \begin{cases} k((n)+1)u(y(n)-St) & St>0 \\ k((n)+1)u(St-y(n)) & St<0 \end{cases}$$

St is the alarm threshold. U(·) is a unit step function $$y(n) = \sum_{i=0}^{N+k(n-1)-2N+K(n-1)-1}\ \sum_{j=1} sign2[sign1(x_0(n-i)-x_0(n-j))+ sign1(x_0(n-j)-RW)]$$

where N is the length of a window. A short window is used in normal detection. After the tendency value has exceeded the alarm threshold, K(n) will increase gradually. Sign2 and sign1 are sign functions.

$$sign1(x) = \begin{cases} 1 & x > s \\ 0 & -s \le x \le s \\ -1 & x < -s \end{cases}$$

$$sign2(x) = \begin{cases} 1 & x > 1 \\ 0 & -1 \le x \le 1 \\ -1 & x < -1 \end{cases}$$

S is a turning threshold. The relative tendency value is defined as $$\tau(n)=y(n)/(N^*(N-1))$$

when $\tau(n)\epsilon[r1, r2]$, the associated matching conditions of each of the progression will be determined. If the associated values exceed the associated predetermined value in their entirety, then it can be confirmed that fire is present.

The associated coefficient is defined as $$\zeta_l(k) = \frac{\mathrm{Min}_l\mathrm{Min}_k\,\Delta_l(k) + \rho\mathrm{Max}_l\mathrm{Max}_k\,\Delta_l(k)}{\Delta_l(k) + \rho\mathrm{Max}_l\mathrm{Max}_k\,\Delta_l(k)}$$

Where $\Delta i(k)=|x_0(k)-x_1(k)|$ is referred to as the absolute difference between the k-th index $x_0$ and $x_1$, $\rho\epsilon(0, +\infty)$ is referred to as distinguishing coefficient, $\mathrm{Min}_l\mathrm{Min}_k\Delta_l(k)$ is referred to as a two-level minimum difference, $\mathrm{Max}_l\mathrm{Max}_k\Delta_l(k)$ is referred to as a two-level maximum difference.

$$\gamma_l = \frac{l}{n}\sum_{k=1}^{n} \xi_l(k)$$

If all of the $\gamma_1$ are not less than R, it means that each of the progression satisfies the associated matching conditions.

What is claimed is:

1. A method of detecting fire by smoke-emission analysis, comprising the steps of:

training across a monitored area to be protected against fire from one side a plurality of discrete infrared beams capable of being intercepted by smoke particles emitted upon development of a fire condition;

detecting the discrete infrared beams on another side of the monitored area and generating video signals in response to detecting, the generated video signals representing attenuation of the discrete infrared beams by smoke particles;

processing the video signals to determine at least a possibility of a fire condition in the monitored area;

enabling an alarm in response to determining the fire condition if:

upon comparing each of the processed video signals to an alarm threshold, the processed video signal exceeds the alarm threshold, upon sequentially comparing each of the processed video signals to the alarm threshold and a turning threshold, a respective processed video signal exceeds the turning threshold, or upon determining that all of the processed video signals exceed the turning threshold.

2. The method according to claim 1, wherein the processing is performed by a computer employing a method selected from the group consisting of template matching, tendency analysis, correlation analysis and a combination of these.

3. The method according to claims 1, further comprising the steps of transferring the generated video signals to a video switcher, and sequentially sending the transferred video signals one by one in a polling manner to a processor operative to determine the possibility of the fire condition.

4. A system for detecting fire by smoke-emission analysis, comprising:

a plurality of infrared radiation arrays mounted in an area to be protected against fire and operative to generate discrete infrared light beams passing across the area and being interceptable by smoke particles emitted upon development of a fire condition;

a plurality of detectors mounted in the area at a distance from the infrared radiation array and each operative to detect a respective discrete infrared beam and to generate a respective video signal in response to detecting, the generated video signals representing attenuation of the discrete infrared beams by smoke particles;

a computer operative to process the video signals to determine at least a possibility of a fire condition in the area and to generate an alarm in response to the processing of the video signals in response to determining the fire condition in:

a first fire recognition mode, wherein each of the processed signals is compared to an alarm threshold and enables the alarm upon exceeding the alarm threshold, a second fire recognition mode, wherein each processed signal is sequentially compared to the alarm threshold and a turning threshold to determine tendency corresponding to the fire condition in the monitored area, the processor enabling the alarm only if a respective processed signal exceeds the turning threshold, and a third fire recognition mode, wherein the alarm is enabled if all of the processed signals exceed the turning threshold.

5. The system according to claim 4, wherein the detectors include infrared cameras.

6. The system according to claim 5, further comprising a video switcher operative to sequentially receive the generated video signals from the infrared cameras and to sequentially transfer the received generated video signals to the computer.

7. A system for detecting fire by smoke-emission analysis, comprising:

a plurality of radiation arrays mounted in an area to be protected against fire and operative to generate a plurality of discrete light beams passing across the area and being interceptable by smoke particles emitted upon development of a fire condition;

a plurality of detectors mounted in the area at a distance from the infrared radiation arrays and each operative to detect a respective discrete light beam and to generate a respective video signal in response to detecting of the light beam, the generated video signals representing attenuation of the discrete light beams by smoke particles, each light beam being characterized by a respective intensity reduced upon penetration through smoke articles in accordance with the following formula $$I_\lambda = I_{\lambda 0}\exp(-KL),$$

wherein $I_\lambda$ is the detected light bam, $I_{\lambda 0}$ is the intensity of the radiated light beam, L is the average run length of the light beam, and K is the extinction coefficient and is a function of the diameter of the smoke particles and their density;

a processor operative to process the video signals to determine at least a possibility of a fire condition in the space and to generate an alarm in response to the processing of the video signals in response to determining the fire condition.

8. The system according to claim 7, further comprising a video switcher operative to sequentially receive the detected video signals and to sequentially send the received video signals to the processor.

9. A system for detecting fire by smoke emission analysis, comprising:

a plurality of radiation arrays mounted in an area to be protected against fire and operative to generate a plurality of discrete light beams passing across the area and being interceptable by smoke particles emitted upon development of a fire condition;

a plurality of detectors mounted in the area at a distance from the infrared radiation arrays and each operative to detect a respective discrete light beam and to generate a respective video signal in response to detecting, the generated video signals representing attenuation of the discrete light beams by smoke particles;

a processor operative to process the video signals to determine at least a possibility of a fire condition in the space and to generate an alarm in response to the processing of the video signals in response to determining the fire condition, the processor being a computer operable in a first fire recognition mode, wherein each of the processed signals is compared to an alarm threshold and enables the alarm upon exceeding the alarm threshold; a second fire recognition mode, wherein each processed signal is sequentially compared to the alarm threshold and a turning threshold to determine tendency corresponding to the fire condition in the monitored area, the processor enabling the alarm only if a respective processed signal exceeds the turning threshold; and a third fire recognition mode, wherein the alarm is enabled if all of the processed signals exceed the turning threshold.

* * * * *